US005994830A

United States Patent [19]

Nose et al.

[11] Patent Number: 5,994,830

[45] Date of Patent: Nov. 30, 1999

[54] NARROW-NECK CRT HAVING A LARGE STEM PIN CIRCLE

[75] Inventors: Hisashi Nose, Chiba; Takao Nakamura; Hidehiro Koumura, both of Mobara, all of Japan

[73] Assignee: Hitachi, Ltd., Tokyo, Japan

[21] Appl. No.: 09/281,811

[22] Filed: Mar. 31, 1999

Related U.S. Application Data

[63] Continuation of application No. 08/916,961, Aug. 25, 1997, Pat. No. 5,898,264.

[30] Foreign Application Priority Data

Sep. 10, 1996 [JP] Japan ..... 8-239496

[51] Int. Cl.[6] ..... H01J 31/00

[52] U.S. Cl. ..... 313/477 HC; 313/318.01; 313/318.05

[58] Field of Search ..... 313/477 HC, 318.08, 313/318.06, 318.05, 318.01; 445/45

[56] References Cited

U.S. PATENT DOCUMENTS 4,504,763 3/1985 Nakanishi et al. .

5,777,430 7/1998 Ueda et al. .

5,818,155 10/1998 Kawamura et al. .

*Primary Examiner*—Vip Patel

*Attorney, Agent, or Firm*—Antonelli, Terry, Stout & Kraus, LLP

[57] ABSTRACT

A cathode ray tube includes a panel portion having a phosphor screen, a neck portion having a stem fused and sealed to one end thereof, the stem having a plurality of stem pins annularly arrayed, sealed thereto and extending therethrough for supporting an electron gun in the neck portion and a funnel portion for connecting the other end of the neck and panel portions. A stem mound is raised and formed integrally with the stem around a base of each of the stem pins on an electron-gun-supporting side thereof. A first R1 is defined as a distance from a center axis of portion to an inner wall in a region of the neck portion facing a major portion of the electron gun, a second distance R2 is defined as a distance from the center axis tide edge of the stem mound, measured at half an axis of the stem mound, the first distance R1 and the second distance R2 satisfy a relationship, 0<R1−R2<2.1 mm. A wall thickness of a region of the neck portion in the vicinity of the fused and sealed regions of the neck portion and the stem is smaller than a wall thickness of a region of the neck portion facing the major portion of the electron gun.

22 Claims, 10 Drawing Sheets

NARROW-NECK CRT HAVING A LARGE STEM PIN CIRCLE

CROSS REFERENCE TO RELATED APPLICATION

This is a continuation of U.S. application Ser. No. 08/916,961, filed Aug. 25, 1997, now U.S. Pat. No. 5,898,264 the subject matter of which is incorporated by reference herein.

BACKGROUND OF THE INVENTION

The present invention relates to a cathode ray tube, and particularly to a cathode ray tube including a stem having a plurality of stem pins annularly arrayed, and sealed and extending therethrough and having glass mounds raised and surrounding the base of each of the stem pins on the side thereof supporting an electron gun, and a neck portion at one end thereof heat-sealed by the stem.

Generally, a color cathode ray tube known as a cathode ray tube emitting a plurality of electron beams has a vacuum envelope composed of a panel portion having a phosphor screen coated with a phosphor on the inner surface thereof and suspending a shadow mask therein closely spaced from the phosphor screen, a funnel portion connected to and tapered down from the panel portion, a neck portion connected, thereto, and a stem supporting an electron gun housed in the neck portion and fused to an open end of the neck portion.

The stem has a plurality of stem pins annularly arrayed and sealed and extending therethrough to support electrodes of the electron gun and introduce various signal voltages from an external circuit.

A deflection yoke is mounted exteriorly in a transition region between the funnel portion and the neck portion, and a plurality of electron beams modulated by video signals and emitted from the electron gun are deflected in two directions, i.e. horizontally and vertically to thereby reproduce a visible image on the phosphor screen.

FIG. 7 is a schematic sectional view for explaining the schematic construction of a color cathode ray tube to which the present invention is applied. Reference numeral 13 designates stem pins, 14 a stem, 20 a panel portion, 21 a neck portion, 22 a funnel portion, 23 a phosphor screen, 24 a shadow mask, 25 a mask frame, 26 a magnetic shield, 27 a shadow mask suspension mechanism, 28 an electron gun, 29, a deflection yoke, and 30 an external magnetic adjustment device.

As described above, the color cathode ray tube of this kind has a vacuum envelope compressing the panel portion 20, the neck portion 21, and the funnel portion 22 for connecting the panel portion 20 and the neck portion 21.

The panel portion 20 is formed with the phosphor screen 23 coated with three-color phosphors in the inner surface, the electron gun 28 for emitting three electron beams in a line is housed in the neck portion 21, and the shadow mask 24 having a multiplicity of apertures or a parallel array of narrow strips is arranged in the vicinity of the phosphor screen of the panel portion 20.

The deflection yoke 29 is mounted exteriorly in the transition region between the funnel portion 22 and the neck portion 21.

The electron gun 28 is housed in the neck portion 21, and the stem 14 has a plurality of stem pins 13 annularly arrayed and sealed and extending therethrough to support electrodes of the electron gun and introduce various signal voltages from an external circuit.

Three electron beams (Bc, Bs×2) modulated by video signals and emitted from the electron gun are deflected in two directions, i.e. horizontally and vertically by horizontal and vertical deflection magnetic fields generated by the deflection yoke 29, and are subjected to color selection at apertures in the shadow mask 24 to impinge on the respective phosphors thereby forming a color image.

FIG. 8 is a side view for explaining one example of an electron gun for a cathode ray tube. Reference numeral 1 designates a cathode, 2 a first grid electrode, 3 a second grid electrode, 4 a third grid electrode, 5 a fourth grid cathode, 6 a fifth grid electrode, 7 a sixth grid electrode, 7*a* a shield cup, and 8 glass rods for holding the electrodes in position (beading glass). Reference numeral 13 designates stem pins, and 14 a stem.

In FIG. 8, controlling and pre-focusing of electron beams are carried out by the first grid electrode 2 to the fourth grid electrode 5. The fifth grid electrode 6 as a focus electrode and the sixth grid electrode 7 as an anode constitute a main lens.

The shield cup 7*a* is connected to the anode 7 (the sixth grid electrode) and serves as an electrode part for fixing contact springs for centering the electron gun in the neck portion and for supporting a getter.

These electrodes are mounted on the stem by being welded directly or through connecting leads, to the plurality of stem pins 13 which are annularly arrayed on the stem 14, sealed thereto and extending therethrough, then the electrodes are inserted into the neck portion from its open end, and the periphery of the stem 14 is fused and fixed to the end of the neck.

FIG. 9 is an explanatory view of the operation for fusing and sealing the stem to the open end of the neck portion of the cathode ray tube. Reference numeral 10 designates an exhaust tubulation, 13 stem pins, 13*a* inner portions of the stem pins projecting into the interior of the neck portion, 14 a stem, and 21 a neck portion. An electron gun 28 is indicated by dotted lines.

As shown in FIG. 9, the stem 14 for supporting the electron gun 28 at its inner portions 13*a* projecting into the interior of the neck portion is formed of glass material, and is in the form of a flat disk whose outside diameter is smaller than that of the neck portion 21.

Stem mounds 11 are formed at the bases of the inner portions of the stem pins by raising the glass material of the stem 14 to mechanically support the inner portions 13*a* of the stem pins and to prevent the loss of the vacuum.

After the electron gun 28 has been secured to the stem 14, the electron gun is inserted from the open end of the neck portion 21 as indicated by the arrows, the outer peripheral portion of the stem is placed in contact with the open end of the neck portion, and the neck portion and the stem at their junctions are fused and sealed by heating them from outside the outer periphery thereof by a burner or the like.

After the stem is fused and sealed to the neck portion 21 and the vacuum envelope is evacuated to a desired vacuum with the exhaust tubulation 10 connected to a vacuum pumping system, the exhaust tubulation 10 is sealed off.

FIG. 10 is a sectional view of main parts for explaining a fused portion of the neck portion and the stem in sealing a conventional cathode ray tube. Reference numeral 12 designates a groove, and 15 a fused portion. The same reference numerals are used in FIG. 10 as used for corresponding parts in FIGS. 1 to 9.

As explained in FIG. 9, in sealing the cathode ray tube, the stem 14 is placed in contact with the open end of the neck portion 21, their junctions are heated and fused by using a burner or the like, the force is applied so that the stem 14 is somewhat pulled away from the neck portion 21 to thereby form a constricted portion in the fused portion 15 as shown in FIG. 10.

In the aforementioned conventional cathode ray tube sealed off by fusing the stem 14, a sufficiently large difference (R1−R2) between a distance (hereinafter also called an inner radius) R1 from the tube axis to the inner wall in a region of the neck portion housing a major portion of the electron gun 28 supported on the inner portions 13*a* of the stem pins projecting into the interior of the neck portion, and a distance R2 from the tube axis to the outside edge of the stem mounds 11 measured at half the axial height H of the stem mounds 11, has been secured to thereby prevent the occurrence of crack in a fused portion of the stem.

Therefore, for example, a stem having a diameter of 15.24 mm of a circular array of stem mounds 11 (corresponding to a diameter of a stem pin circle) has been coupled to a neck portion having an outside diameter of 29.1 mm and an inside diameter of 23.9 mm. In this case, the minimum value of R1 is approximately 12 mm and the maximum value of R2 is approximately 9.3 mm, and the difference (R1−R2) is nearly equal to 2.7 mm.

There has been a problem in that it is difficult to fuse and seal such a large-pin-circle stem to a neck portion of, for example, a so-called narrow neck low-deflection-power cathode ray tube having a neck narrower than a presently widely used neck having a nominal diameter of 29.1 mm.

There has been another problem in that, since a connecting portion between glass of the stem 14 and glass of the neck portion is very close to the groove 12 formed in the fused portion, crack tends to occur in that portion.

SUMMARY OF THE INVENTION

It is an object of the present invention to overcome the problems as noted above with respect to prior art and provide a cathode ray tube which can prevent occurrence of cracks in the fused portion and which has a stem-neck portion construction capable of fusing and sealing a stem to a narrow neck while retaining a presently used pin circle diameter.

For achieving the aforementioned object, according to an embodiment of the present invention, there is provided a cathode ray tube including a vacuum envelope comprising a panel portion having a phosphor screen on an inner surface thereof and suspending a shadow mask closely spaced from the phosphor screen, a neck portion having a stem fused and sealed to one end thereof, the stem having a plurality of stem pins annularly arrayed, sealed thereto and extending therethrough for supporting an electron gun in the neck portion and a funnel portion for connecting the other end of the neck portion and the panel portion, a stem mound being raised and formed integrally with the stem around a base of each of the plurality of stem pins on an electron-gun-supporting side thereof, a first distance R1 being defined as a distance from a center axis of the neck portion to an inner wall in a region of the neck portion facing a major portion of the electron gun, a second distance R2 being defined as a distance from the center axis to an outside edge of the stem mound, measured at half an axial height of the stem mound, the first distance R1 and the second distance R2 satisfying a relationship, $0<R1-R2<2.1$ mm, and a wall thickness of a region of the neck portion in the vicinity of the fused and sealed regions of the neck portion and the stem is smaller than or equal to a wall thickness of a region of the neck portion facing the major portion of said electron gun.

The present invention can be applied not only to a color cathode ray tube but also any cathode ray tubes of the type in which a stem having a plurality of stem pins is fused to a neck portion.

BRIEF DESCRIPTION OF THE DRAWINGS

In the drawings, which form an integral part of the specification and are to be read in conjunction therewith, and in which like reference numerals designate similar components throughout the figures, and in which.

DETAILED DESCRIPTION OF THE PREFERRED EMBODIMENTS

The present invention will be explained in detail with reference to the embodiments shown in the figures.

First, mechanical data of a small-diameter neck and a large-diameter stem used for cathode ray tubes according to embodiments described later are given in Table 1 as compared with those of conventional cathode ray tubes.

Figure 1:
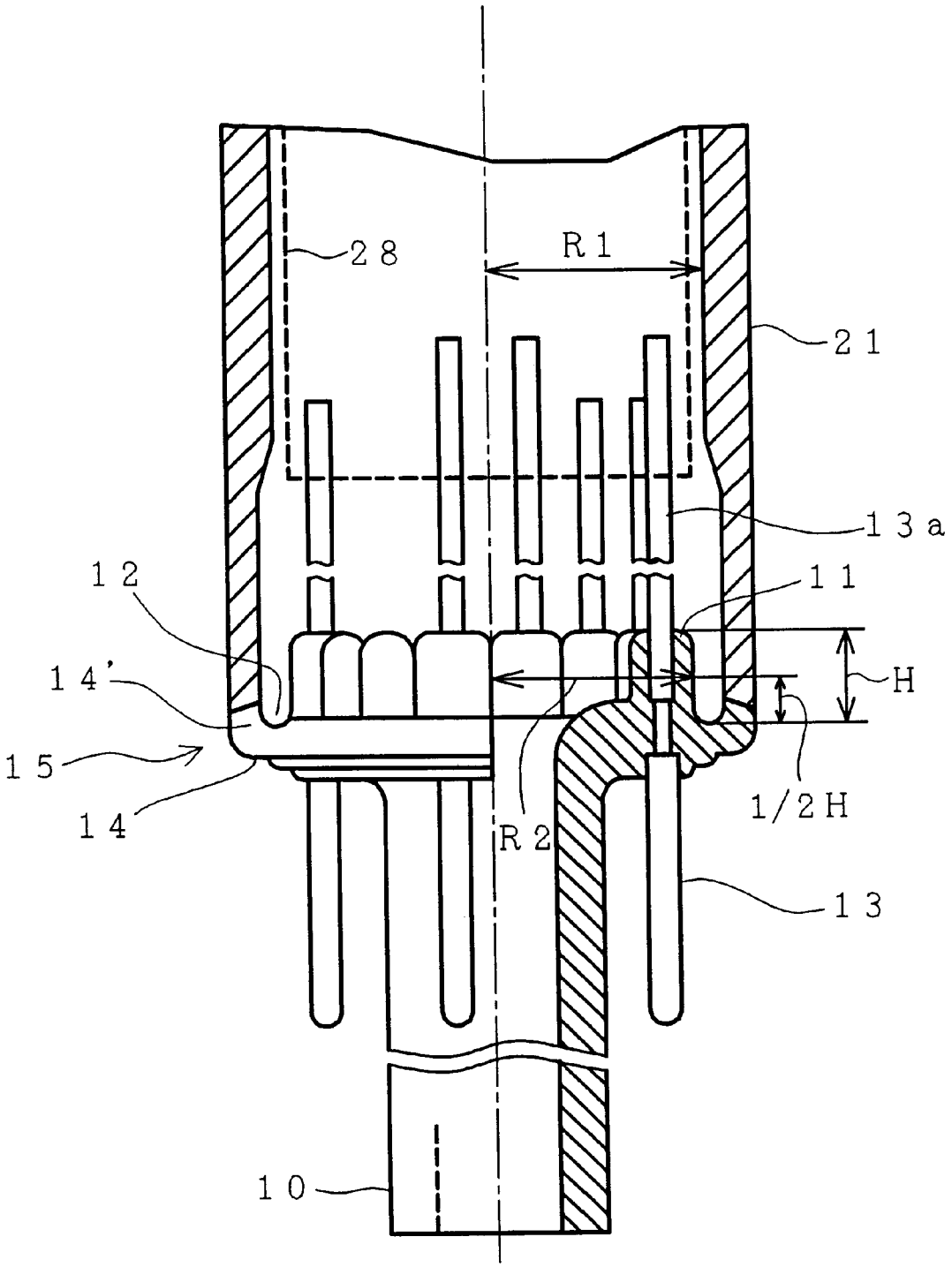
FIG. 1 is a sectional view of main parts of a neck portion of a cathode ray tube for explaining the construction of a first embodiment of the cathode ray tube according to the present invention.
Figure 10:
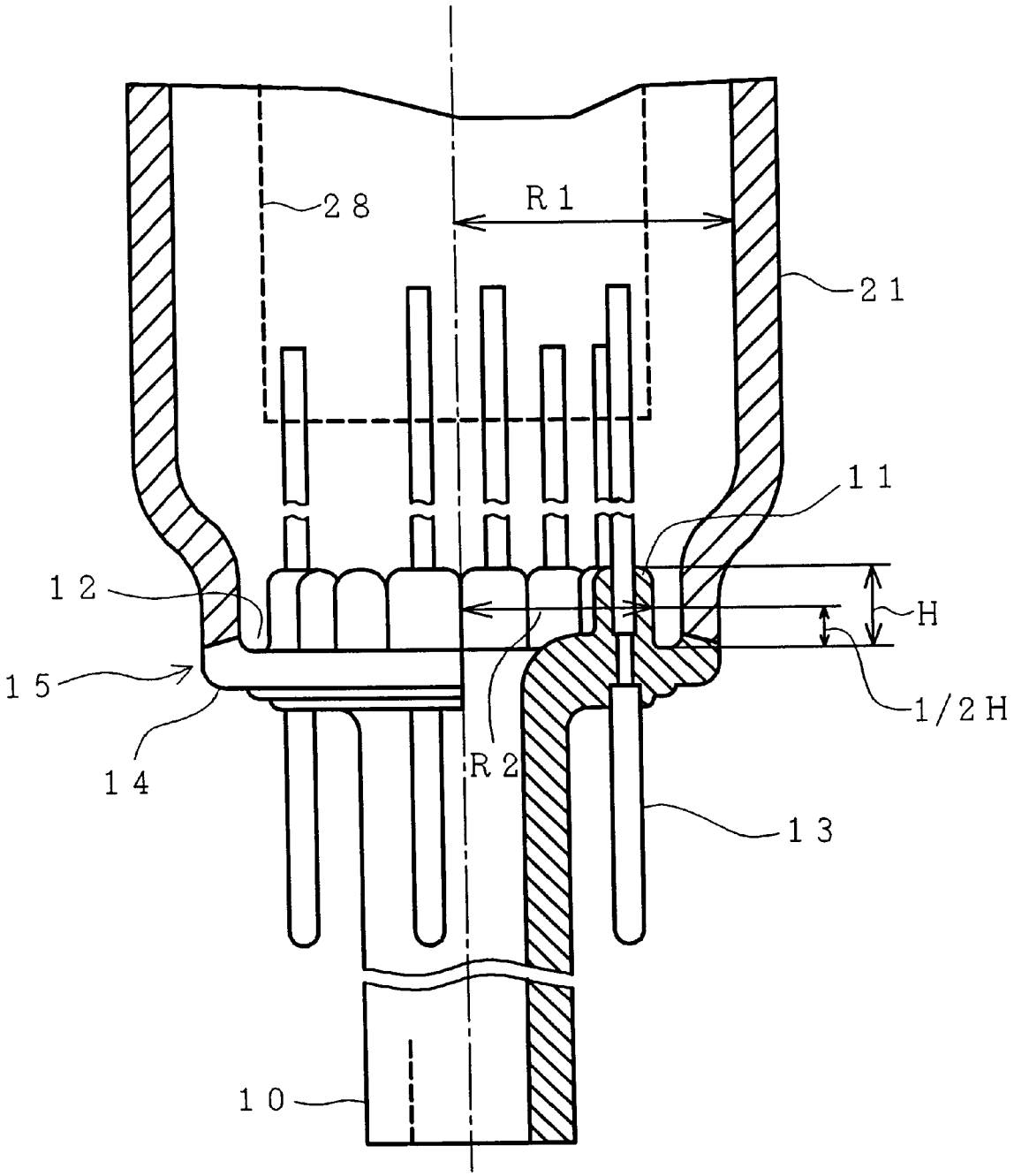
FIG. 10 (PRIOR ART)
FIG. 10 is a sectional view of main parts for explaining a sealed portion of a neck portion and a stem in sealing a conventional cathode ray tube.

FIG. 1 is a sectional view of main parts of a sealed neck portion of a cathode ray tube for explaining the construction of a first embodiment of the cathode ray tube according to the present invention. As used in FIG. 10, reference numeral 10 designates an exhaust tubulation, 12 a groove formed in the sealed portion of the stem and the neck portion, 13 stem pins, 13*a* inner portions of the stem pins projecting into the neck portion, 14 a stem, 14' a rim, 15 a sealed portion, and 21 a neck portion. An electron gun 28 is indicated by the dotted lines.

Figure 2:
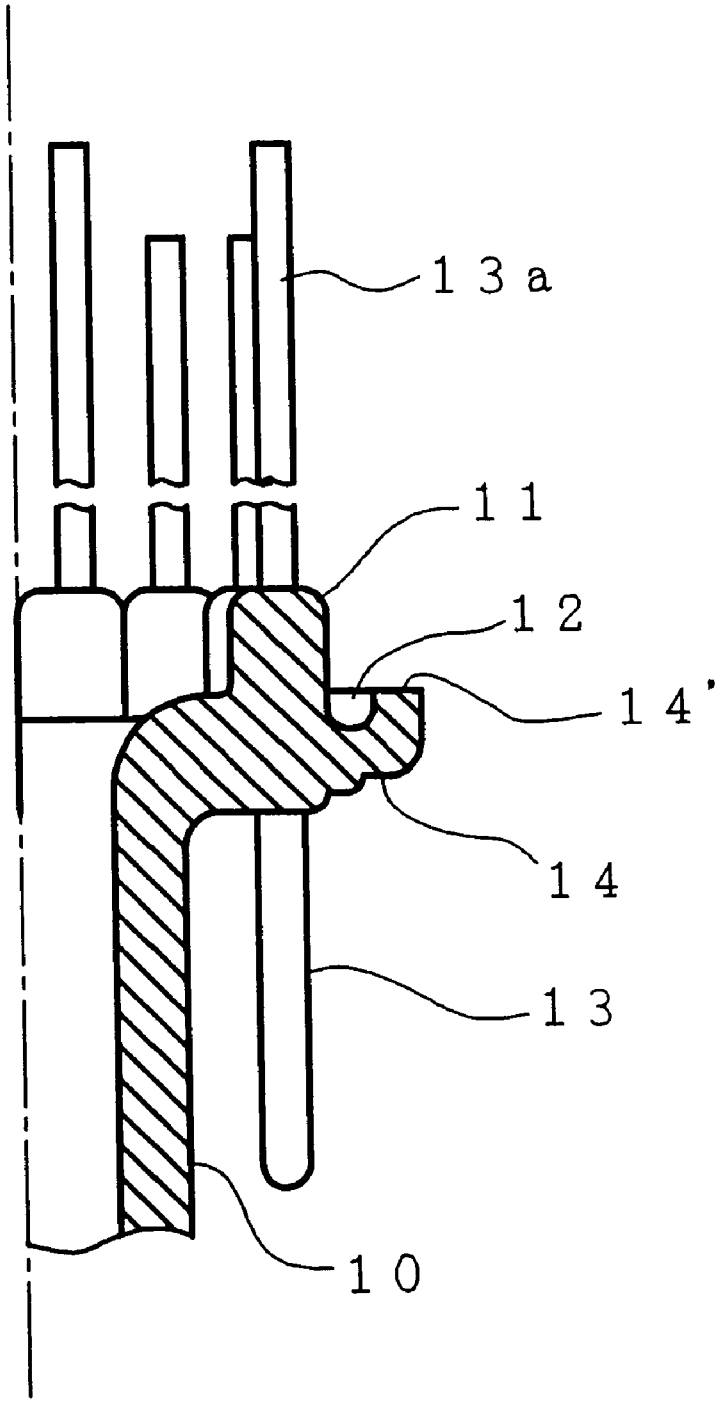
FIG. 2 is a fragmentary sectional view for explaining the construction of the stem of the first embodiment of the cathode ray tube according to the present invention.

FIG. 2 is a fragmentary sectional view for explaining the construction of a stem, before sealing, of the first embodiment of the cathode ray tube according to the present invention.

TABLE 1 Comparison between the Prior Art and an Embodiment of the Present Invention

| | PRIOR ART | | EMBODIMENT OF THE PRESENT INVENTION |
|---|---|---|---|
| | Large-Diameter-Neck CRT | Small-Diameter-Neck CRT | Small-Diameter-Neck CRT |
| Nominal Outside Diameter of Neck | 29.1 mm | 24.3 mm | 24.3 mm |
| Diameter of Stem Circle | 15.24 mm | 12.0 mm | 15.24 m |
| Minimum Angular Spacing between Adjacent Stem Pine | 360°/14 =25.7° | 360°/10 =36° | 360°/14 =25.7° |
| Number of Usable Stem Pins | 10 | 8 | 10 |
| Number of Unused Stem Pin Positions | 4 | 2 | 4 |
| Number of High Voltage Stem Pins Flanked by Unused Stem Pin Positions, for Focus Voltage Application. | 2 | 1 | 2 |

The stem mounds 11 are approximately 3 mm in diameter, and approximately 3.5 mm in height.

As shown, the periphery of the stem 14 is bent toward the neck portion to form the rim 14'. A substantially U-shaped groove 12 is formed between the bent portion and the mounds 11. The end face of the rim 14' is substantially parallel with the bottom surface of the stem 14 so as to substantially closely fit the open end face of the neck portion.

The rim 14' of the stem 14 is fused and sealed to the end of the neck portion 21 so that the U-shaped groove is retained also in a completed tube.

As shown in FIG. 1, the stem 14 for supporting the electron gun 28 through inner portions 13*a* of the stem pins projecting into the neck portion 21 is formed of glass, and is fused and sealed to the end face of the neck portion 21 at the rim 14' formed by bending the periphery of the substantially flat disk-like stem glass toward the neck portion to provide a surface flush with the open end face of the neck portion 21.

A wall thickness of the neck glass in a region short of the vicinity of a region housing a major portion of the electron gun 28 from the open end of the neck portion 21 is made thinner than that of the region housing the major portion of the electron gun 28. The stem mounds 11 are formed by raising the glass of the stem 14 at the bases of the inner portions 13*a* projecting into the neck portion, of the stem pins 13 extending through and sealed in the stem 14 to mechanically hold the inner portions 13*a* and prevent loss of the vacuum.

After the electron gun 28 has been secured to the stem 14, the electron gun portion is inserted from the open end of the neck portion 21, the end face of the rim 14' portion of the stem is placed in contact with the open end face of the neck portion, and the rim 14' portion and the neck portion at their junctions are fused and sealed by heating them from outside their outer periphery with a burner or the like in such that the groove 12 is retained. After the stem is fused and sealed to the neck portion 21 and the vacuum envelope is evacuated to a desired vacuum with the exhaust tubulation 10 connected to a vacuum pumping system, the exhaust tubulation 10 is sealed off. In FIG. 1, R1 designates the distance from the longitudinal axis of the neck portion 21 to the inner wall of the neck portion 21 in a region housing the electron gun, and R2 designates the distance from the longitudinal axis of the neck portion 21 to the outside edge of the stem mounds 11 measured at half the height H of the stem mounds 11 of the stem 14.

According to the constitution of this embodiment, by setting the difference (R1−R2) to satisfy 0<(R1−R2)<2.1 mm a presently used large-diameter-pin-circle stem can be used for the cathode ray tube of a narrow neck, and it becomes possible to prevent occurrences of cracks in the fused portion 15 of the stem because the groove 12 is secured between the stem mounds 11 and the inner wall of the neck portion and this groove is not involved in the fused portion.

In a typical narrow-neck cathode ray tube having a neck portion of a nominal diameter of 24.3 mm, for example, the distance R1 is 9.6 mm. If the distance R2 of 9.1 mm is adopted, the difference (R1−R2) is 0.5 mm, this satisfies the above-mentioned relationship 0<(R1−R2)<2.1 mm.

As shown in Table 1, according to the present embodiment, since a large-diameter stem can be sealed to a narrow neck having a diameter of 24.3 mm, a large pin circle of 15.24 mm in diameter can be adopted as in a conventional cathode ray tube employing a large-diameter neck portion of 29.1 mm in diameter. This stem provides ten stem pins usable for applying suitable voltages to the electrodes within the neck portion from outside the neck portion and four unused pin positions located on the pin circles having no stem pins extending therethrough while a conventional narrow-neck cathode ray tube provided eight stem pins usable for applying voltages from outside the neck portion and two unused pin positions on the pin circle. Accordingly two high-voltage carrying stem pins for applying high voltages such as voltages can be located on the stem pin circles such that stem pin positions having no stem pins extending therethrough are disposed between the two high-voltage carrying stem pins and other low-voltage carrying stem pins. In the conventional narrow-neck cathode ray tube, since only one stem pin for applying a high voltage can be located on the stem pin circle as indicated in Table 1, the dynamic focusing operation was impossible without installing a voltage divider within the tube envelope for obtaining a focus voltage from an anode voltage.

Figure 3:
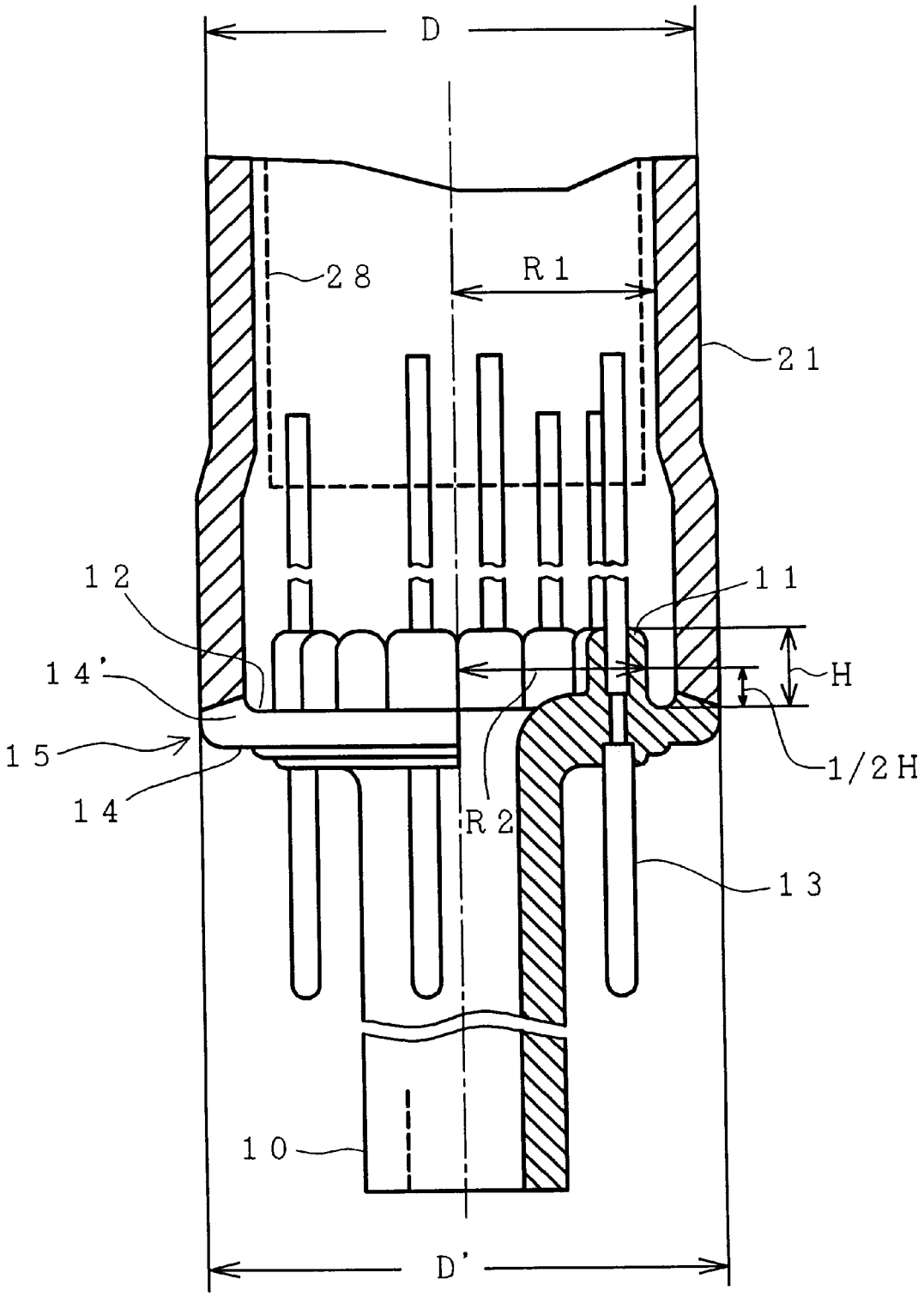
FIG. 3 is a sectional view of main parts of a neck portion of a cathode ray tube for explaining the construction of a second embodiment of the cathode ray tube according to the present invention.

FIG. 3 is a sectional view of main parts of a neck portion, after sealing, of a cathode ray tube for explaining the construction of a second embodiment of the cathode ray tube according to the present invention. The same reference numerals are used in FIG. 3 as used for corresponding parts in FIG. 1.

This embodiment is different from that shown in FIG. 1 in that an outside diameter and an inside diameter of the neck portion at least in the region housing the stem mounds 11 are formed to be larger than that housing the main parts of the electron gun 28.

After the electron gun 28 has been secured to the stem 14 by welding, the electron gun portion is inserted from the open end of the neck portion 21, the end face of the rim 14' portion of the stem is placed in contact with the open end face of the neck portion, and their junctions are heated and fused by using a burner or the like from outside their periphery.

After the stem is fused and sealed to the neck portion 21 and the vacuum envelope is evacuated to a desired vacuum with the exhaust tubulation 10 connected to a vacuum pumping system, the exhaust tubulation 10 is sealed off.

In FIG. 3, R1 designates the distance from the longitudinal axis of the neck portion 21 to the inner wall of the neck portion 21 in a region housing the electron gun, and R2 designates the distance from the longitudinal axis of the neck portion 21 to th e outside edge of the stem mounds 11 measured at half the height H of the stem mounds 11 of the stem 14.

According to the constitution of this embodiment, by setting the difference (R1−R2) to satisfy 0<(R1−R2)<2.1 mm, a presently used large-diameter-pin-circle stem can be used for the cathode ray tube of a narrow neck, and it becomes possible to prevent occurrences of cracks in the fused portion 15 of the stem because the groove 12 is secured between the stem mounds 11 and the inner wall of the neck portion and this groove is not involved in the fused portion.

Further, the present embodiment also can provide the same advantages as in the first embodiment.

In FIG. 3, a diameter D' of an expanded fused portion is about 1.1 times an outside diameter D of the neck portion housing the main parts of the electron gun, and the expanded fused portion does not extend beyond 12 mm from the bottom surface of the stem 14.

Figure 4:
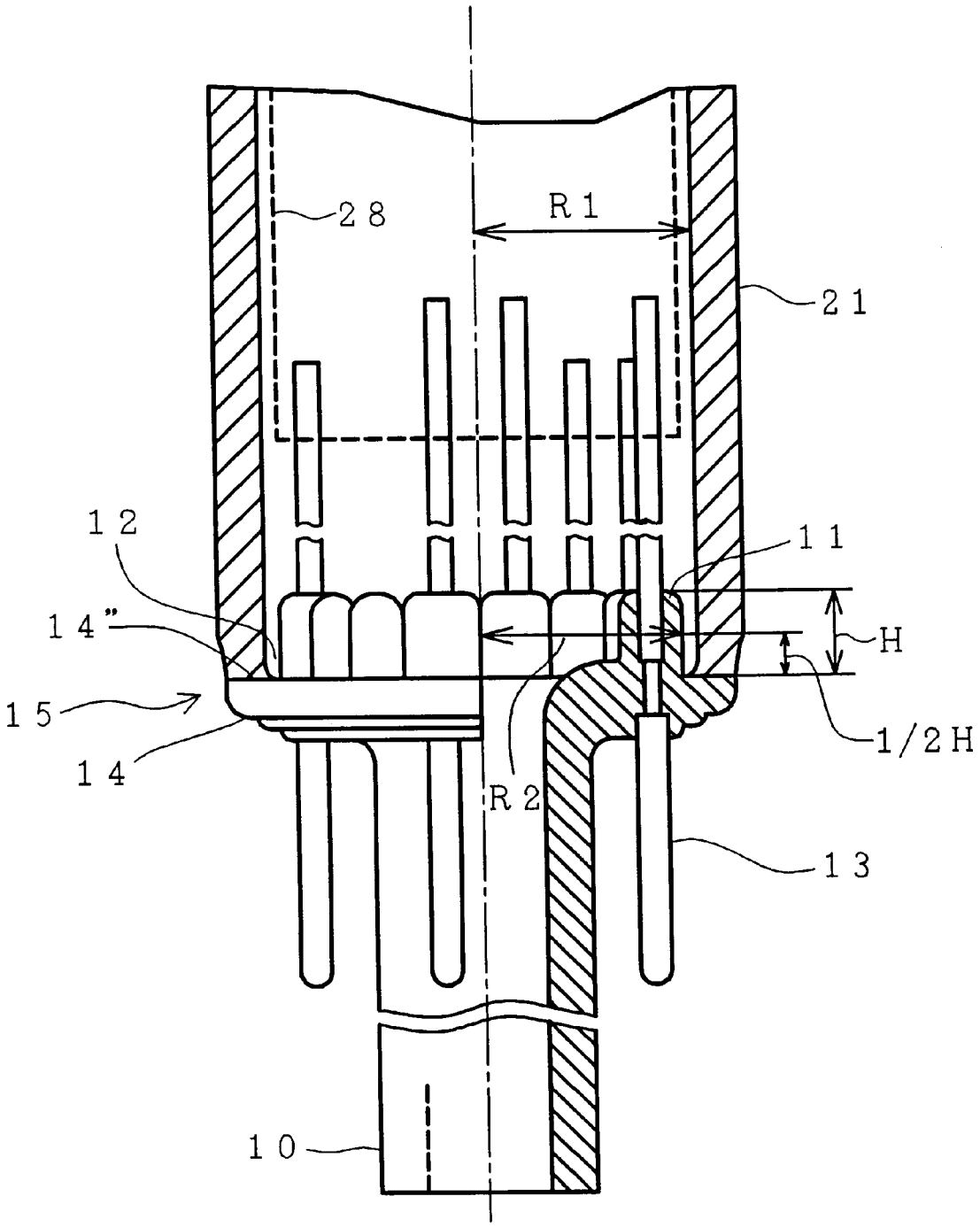
FIG. 4 is a sectional view of main parts of a neck portion of a cathode ray tube for explaining the construction of a third embodiment of the cathode ray tube according to the present invention.

FIG. 4 is a sectional view of main parts of a neck portion, after sealing, of a cathode ray tube for explaining the construction of a third embodiment of the cathode ray tube according to the present invention. The same reference numerals are used in FIG. 4 as used for corresponding parts in FIG. 1.

Figure 5:
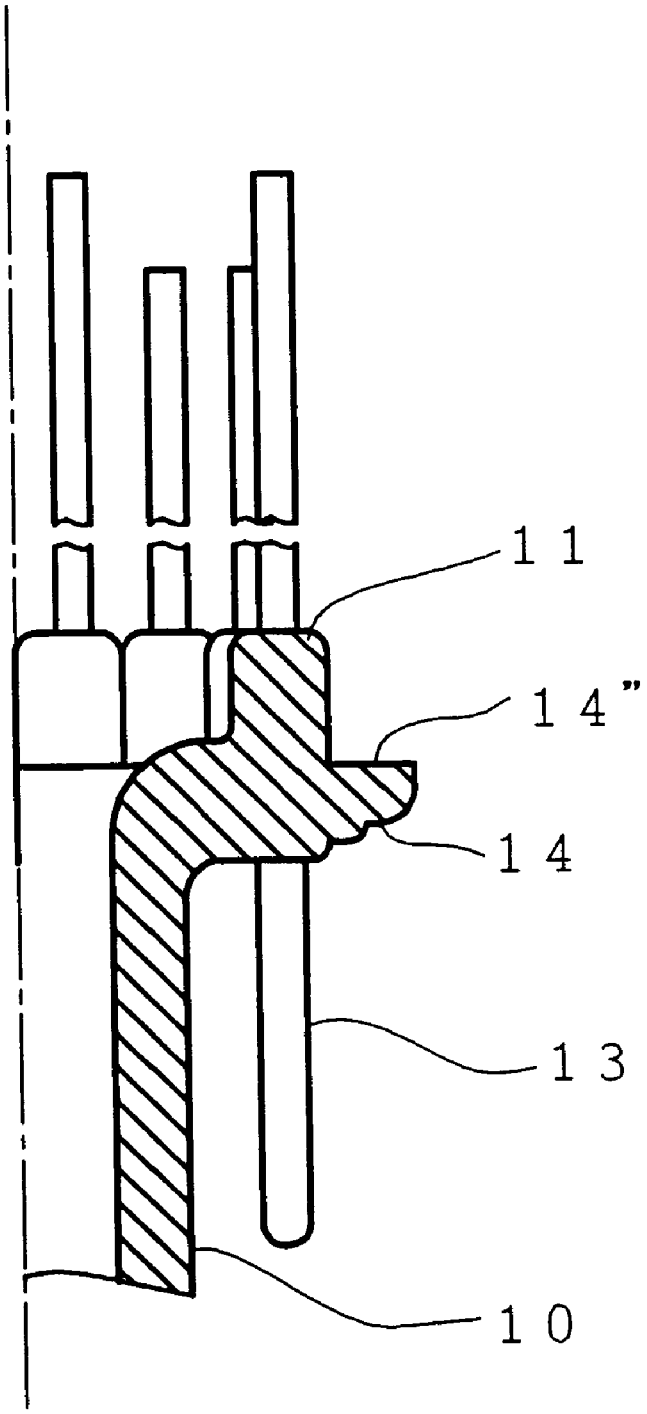
FIG. 5 is a fragmentary sectional view for explaining the construction of the stem of the third embodiment of the cathode ray tube according to the present invention.

In this embodiment, the outside diameter of the stem 14 is nearly equal to that of the neck portion 21 at its open end fused to the stem, and the construction of the stem used is shown in FIG. 5 which is a fragmentary sectional view for explaining the construction of the stem of the third embodiment of the cathode ray tube according to the present invention. The periphery of the stem 14 has a flat surface 14". The end of the neck portion 21 is fused and sealed to the flat surface 14". As shown in FIG. 4, the wall thickness of the neck portion 21 retains the same value from the region housing the electron gun to the vicinity of the portion fused to the stem.

In FIG. 4, R1 designates the distance from the longitudinal axis of the neck portion 21 to the inner wall of the neck portion 21 in a region housing the electron gun, and R2 designates the distance from the longitudinal axis of the neck portion 21 to the outside edge of the stem mounds 11 measured at half the height H of the stem mounds 11 of the stem 14.

According to the constitution of this embodiment, by setting the difference (R1−R2) to satisfy 0<(R1−R2)<2.1 mm, a presently used large-diameter-pin-circle stem can be used for the cathode ray tube of a narrow neck, and it becomes possible to prevent occurrences of cracks in the fused portion 15 of the stem because the groove 12 is secured between the stem mounds 11 and the inner wall of the neck portion and this groove is on the flat surface 14".

Further, the present embodiment also can provide the same advantages as in the first embodiment.

Figure 6:
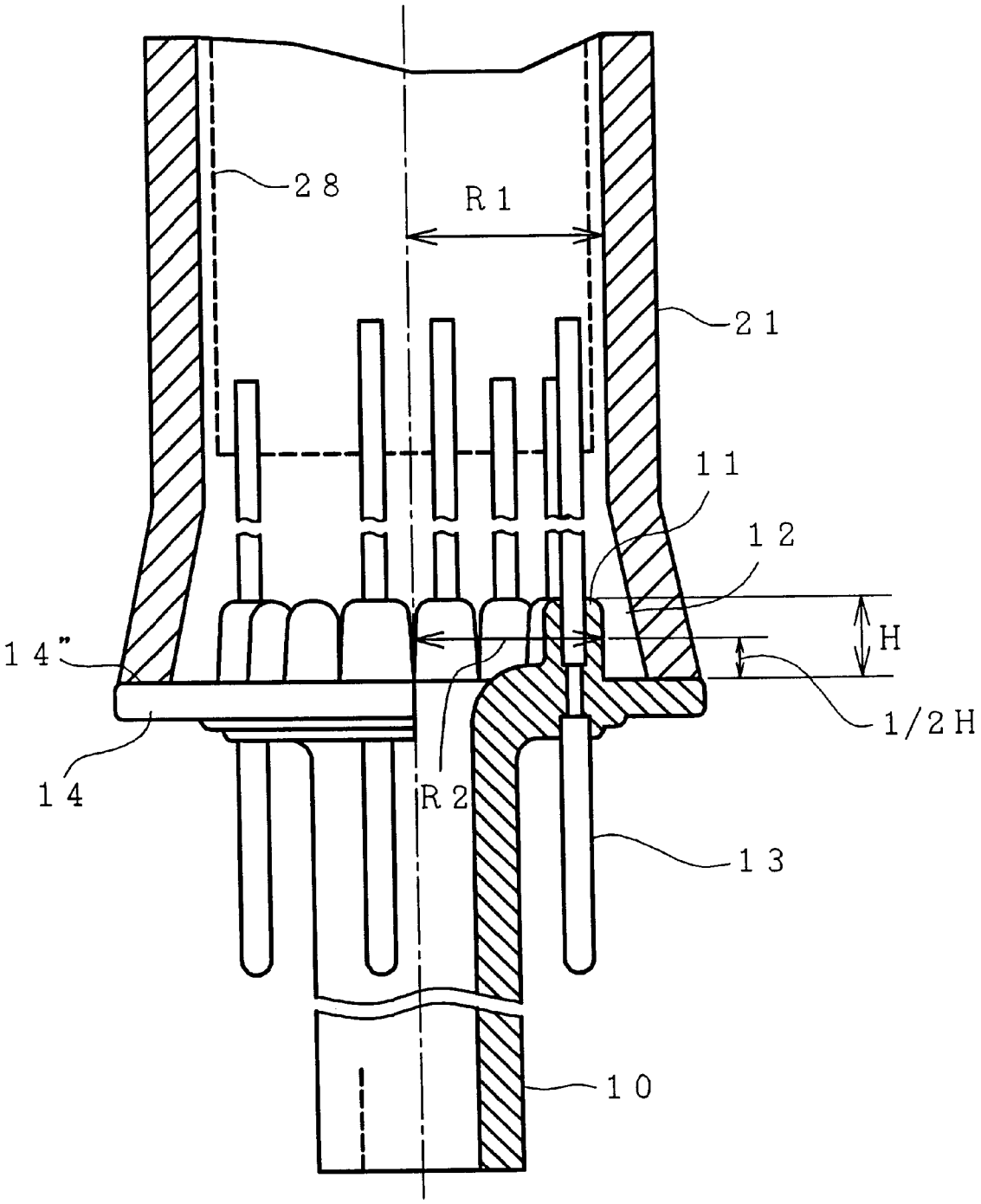
FIG. 6 is a sectional view of main parts of a neck portion of a cathode ray tube for explaining the construction of a fourth embodiment of the cathode ray tube according to the present invention.
Figure 7:
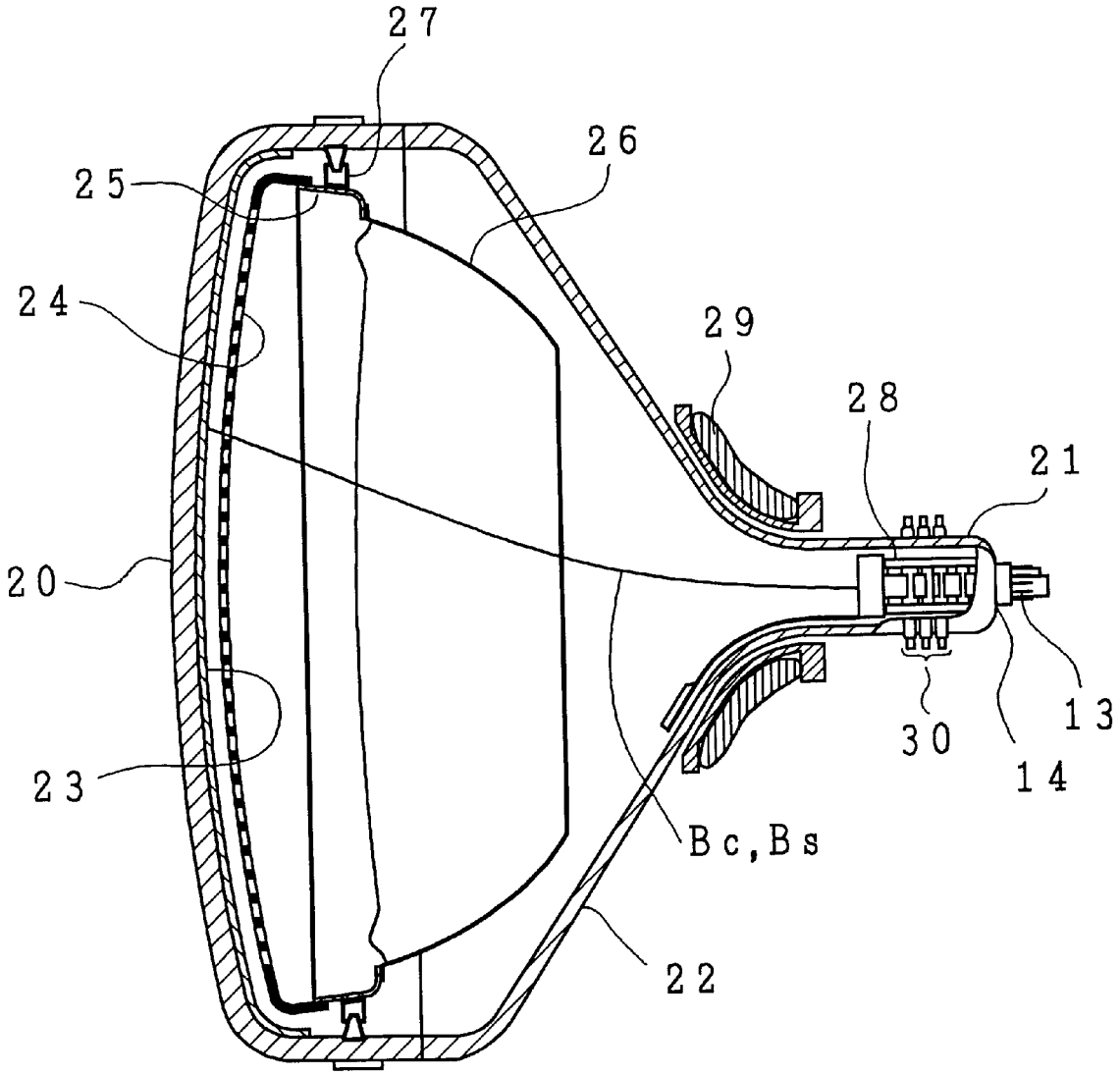
FIG. 7 is a schematic sectional view for explaining the schematic construction of a color cathode ray tube to which the present invention is applied.
Figure 8:
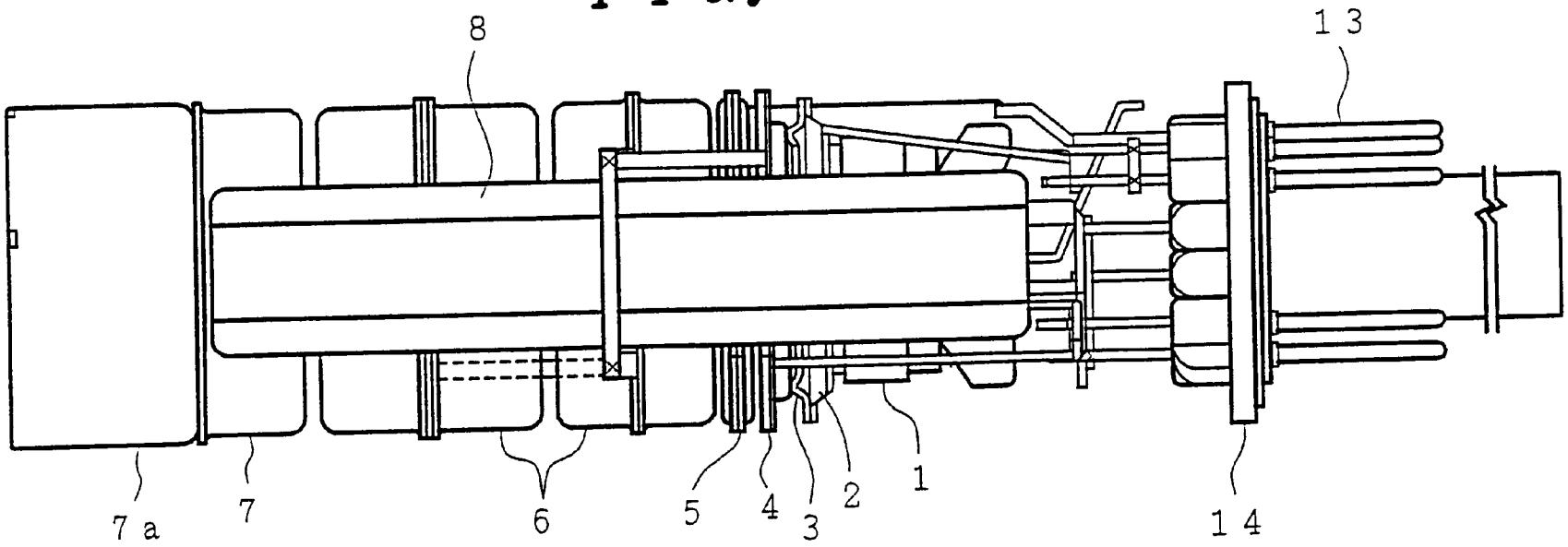
FIG. 8 is a side view for explaining one example of an electron gun for a cathode ray tube.
Figure 9:
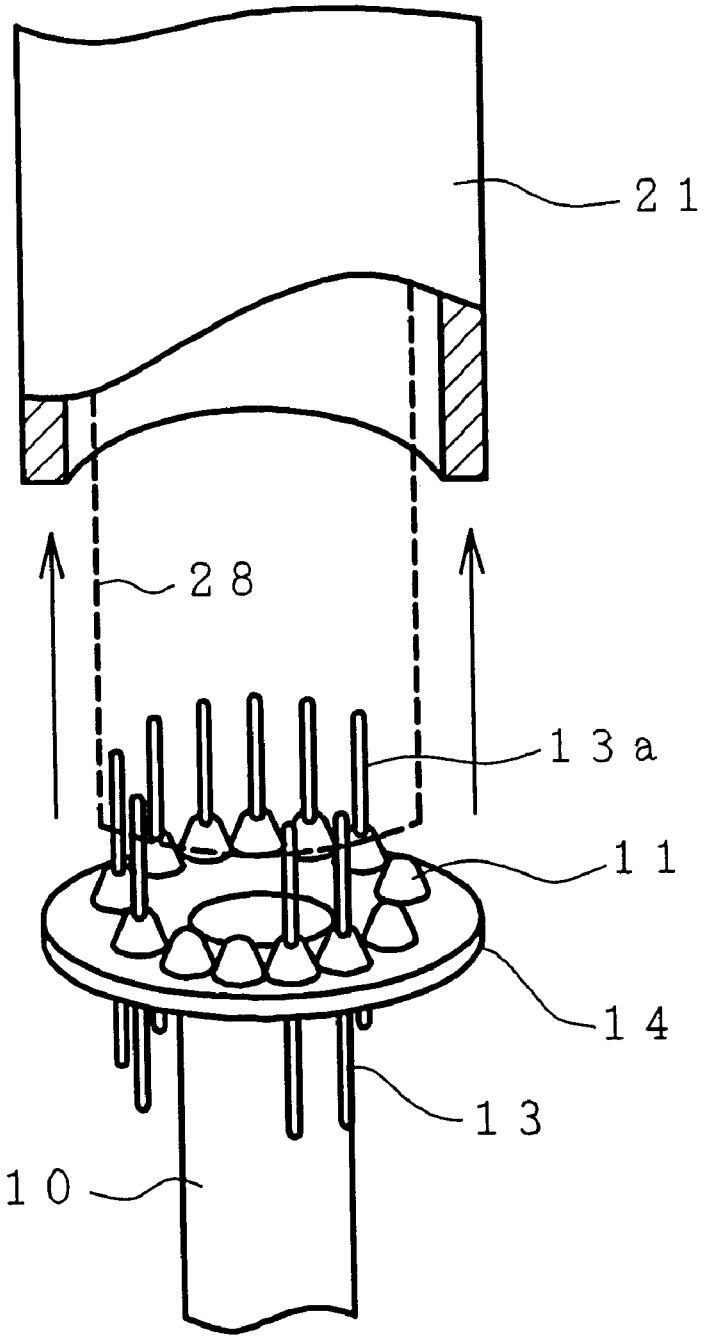
FIG. 9 is an explanatory view of an operation for f using and sealing a stem to an open end of a neck portion in sealing the cathode ray tube.

FIG. 6 is a sectional view of main parts of a neck portion of a cathode ray tube for explaining the construction of a fourth embodiment of the cathode ray tube according to the present invention. The same reference numerals are used in FIG. 6 as used for corresponding parts in FIG. 1.

In this embodiment, the neck portion 21 has a uniform wall thickness, has a progressively larger diameter, which increases by less than 3 mm in a radial direction, toward its open end from a position 10 mm from the open end, and is fused and sealed to the stem of the shape shown in FIG. 5.

In FIG. 6, R1 designates the distance from the longitudinal axis of the neck portion 21 to the inner wall of the neck portion 21 in a region housing the electron gun and R2 designates the distance from the longitudinal axis of the neck portion 21 to the outside edge of the stem mounds 11 measured at half the height H of the stem mounds 11 of the stem 14.

According to the constitution of this embodiment, by setting the difference (R1−R2) to satisfy 0<(R1−R2)<2.1 mm, a presently used large-diameter-pin-circle stem can be used for the cathode ray tube of a narrow neck, and it becomes possible to prevent occurrences of cracks in the fused portion 15 of the stem because the groove 12 is secured between the stem mounds 11 and the inner wall of the neck portion and this groove is on the flat surface 14".

Further, the present embodiment also can provide the same advantages as in the first embodiment.

While in the present invention, a description has been made of the method for fusing and sealing the stem of the shape as shown in FIG. 2 in connection with the embodiments 1 and 2, it is to be noted that after the stem of the shape as shown in FIG. 5 has been fused to the neck tube, the stem and the neck tube can be altered so as to have the shape of the embodiments 1 and 2.

As described above, according to the present invention, it is possible to use a presently used large-diameter stem to seal a cathode ray tube having a smaller diameter neck portion. It is possible to provide a cathode ray tube of reduced power consumption. Moreover, it is possible to realize an electron gun of the dynamic focus type having a narrow neck portion sealed with a presently used stem having a sufficient number of stem pins.

According to the present invention, even if the outside diameter of the neck portion is reduced to less than 29.1 mm, further, less than 27 mm, it is possible to provide a cathode ray tube employing a stem having a stem pin-circle diameter not less than 14 mm.

It has been found by experiment that, in a case of a combination of a neck portion having an outside diameter not more than 27 mm and a stem having a stem pin circle diameter not less than 12.5 mm, it is sufficient that the abovementioned difference (R1−R2) satisfies the relationship 0<R1−R2≦1 mm, where R1 designates a distance from the longitudinal axis of the neck portion 21 to the inner wall of the neck portion 21 in a region housing an electron gun, and R2 designates a distance from the longitudinal axis of the neck portion 21 to the outside edge of the stem mounds 11 raised integral with the stem at the base of the inner portions of the stem pins, measured at half the height H of the stem mounds 11.

What is claimed is:

1. A cathode ray tube including a vacuum envelope comprising a panel portion having a phosphor screen on an inner surface thereof and suspending a shadow mask closely spaced from said phosphor screen, a neck portion having a stem fused and sealed to one end thereof, said stem having a plurality of stem pins annularly arrayed, sealed thereto and extending therethrough for supporting an electron gun in said neck portion and a funnel portion for connecting the other end of said neck portion and said panel portion, a stem mound being raised and formed integrally with said stem around a base of each of said plurality of stem pins on an electron-gun-supporting side thereof, a first distance R1 being defined as a distance from a center axis of said neck portion to an inner wall in a region of said neck portion facing a major portion of said electron gun, a second distance R2 being defined as a distance from said center axis to an outside edge of said stem mound as measured at half an axial height of said stem mound, said first distance R1 and said second distance R2 satisfying a relationship, $0<R1-R2<2.1$ mm, and a wall thickness of a region of said neck portion in the vicinity of said fused and sealed regions of said neck portion and said stem is smaller than a wall thickness of a region of said neck portion facing said major portion of said electron gun.

2. The cathode ray tube according to claim 1, wherein a third distance which is defined as a distance from an inner wall of said neck portion to said center axis is not smaller than said first distance R1 in a region of said neck portion facing said stem mounds except in the vicinity of said fused and sealed regions of said neck portion and said stem.

3. The cathode ray tube according to claim 2, wherein said third distance is larger than said first distance R1 in a region of said neck portion facing said stem mounds except in the vicinity of said fused and sealed regions of said neck portion and said stem.

4. The cathode ray tube according to claim 2, wherein an outside diameter of said neck portion at said fused and sealed regions is substantially equal to an outside diameter of said neck portion facing said major portion of said electron gun.

5. The cathode ray tube according to claim 1, wherein an outside diameter of said neck portion facing said major portion of said electron gun is not more than 29.1 mm.

6. The cathode ray tube according to claim 4, wherein a diameter of a pin circle of said plurality of stem pins is at least 14 mm.

7. The cathode ray tube according to claim 1, wherein an outside diameter of said neck portion facing said major portion of said electron gun is not more than 27 mm.

8. The cathode ray tube according to claim 7, wherein a diameter of a pin circle of said plurality of stem pins is at 12.5 mm.

9. The cathode ray tube according to claim 8, wherein said first distance R1 and said second distance R2 satisfy a relationship, $0<R1-R2\leqq 1$ mm.

10. A cathode ray tube including a vacuum envelope comprising a panel portion having a phosphor screen on an inner surface thereof and suspending a shadow mask closely spaced from said phosphor screen, a neck portion having a stem fused and sealed to one end thereof, said stem having a plurality of stem pins annularly arrayed, sealed thereto and extending therethrough for supporting an electron gun in said neck portion and a funnel portion for connecting the other end of said neck portion and said panel portion, a stem mound being raised and formed integrally with said stem around a base of each of said plurality of stem pins on an electron-gun-supporting side thereof, a first distance R1 being defined as a distance from a center axis of said neck portion to an inner wall in a region of said neck portion facing a major portion of said electron gun, a second distance R2 being defined as a distance from said center axis to an outside edge of said stem mound as measured at half an axial height of said stem mound, said first distance R1 and said second distance R2 satisfying a relationship, $0<R1-R2<2.1$ mm, and a wall thickness of a region of said neck portion in the vicinity of said fused and sealed regions of said neck portion and said stem is approximately equal to a wall thickness of a region of said neck portion facing said major portion of said electron gun.

11. The cathode ray tube according to claim 10, wherein an outside diameter of said neck portion at said fused and sealed regions is larger than an outside diameter of said neck portion facing said major portion of said electron gun.

12. The cathode ray tube according to claim 10, wherein a third distance which is defined as a distance from an inner wall of said neck portion to said center axis is not smaller than said first distance R1 in a region of said neck portion facing said stem mounds except in the vicinity of said fused and sealed regions of said neck portion and said stem.

13. The cathode ray tube according to claim 12, wherein said third distance is larger than said first distance R1 in a region of said neck portion facing said stem mounds except in the vicinity of said fused and sealed regions of said neck portion and said stem.

14. The cathode ray tube according to claim 10, wherein an outside diameter of said neck portion at said fused and sealed regions is substantially equal to an outside diameter of said neck portion facing said major portion of said electron gun.

15. The cathode ray tube according to claim 10, wherein an inside diameter of said neck portion at said fused and sealed regions is substantially equal to an inside diameter of said neck portion facing said major portion of said electron gun.

16. The cathode ray tube according to claim 10, wherein an outside diameter of said neck portion increases progressively from an outside diameter of said neck portion facing said major portion of said electron gun toward said fused and sealed regions.

17. The cathode ray tube according to claim 10, wherein an inside diameter of said neck portion increases progressively from an inside diameter of said neck portion facing said major portion of said electron gun toward said fused and sealed regions.

18. The cathode ray tube according to claim 10, wherein an outside diameter of said neck portion facing said major portion of said electron gun is not more than 29.1 mm.

19. The cathode ray tube according to claim 18, wherein a diameter of a pin circle of said plurality of stem pins is at least 14 mm.

20. The cathode ray tube according to claim 10, wherein an outside diameter of said neck portion facing said major portion of said electron gun is not more than 27 mm.

21. The cathode ray tube according to claim 20, wherein a diameter of a pin circle of said plurality of stem pins is at least 12.5 mm.

22. The cathode ray tube according to claim 21, wherein said first distance R1 and said second distance, R2 satisfy a relationship, $0<R1-R2\leqq 1$ mm.

* * * * *